US006820973B2

(12) United States Patent
Ujita

(10) Patent No.: US 6,820,973 B2
(45) Date of Patent: Nov. 23, 2004

(54) LIQUID SUPPLY APPARATUS AND PRINTING APPARATUS

(75) Inventor: Toshihiko Ujita, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 51 days.

(21) Appl. No.: 10/303,708

(22) Filed: Nov. 26, 2002

(65) Prior Publication Data

US 2003/0128251 A1 Jul. 10, 2003

(30) Foreign Application Priority Data

Jan. 4, 2002 (JP) ..... 2002-000168

(51) Int. Cl.[7] ..... B41J 2/175
(52) U.S. Cl. ..... 347/85
(58) Field of Search ..... 347/22, 29–35, 347/84–87

(56) References Cited

U.S. PATENT DOCUMENTS 6,637,872 B2 * 10/2003 Ara et al. ..... 347/85

* cited by examiner

*Primary Examiner*—Shih-Wen Hsieh
(74) *Attorney, Agent, or Firm*—Fitzpatrick, Cella, Harper & Scinto

(57) ABSTRACT

A simple configuration is used to prevent a gas-liquid separating membrane which allows a gas to pass through while hindering the passage of a liquid, from undergoing a pressure equal to or higher than the withstanding pressure of the membrane, thus enabling a liquid to be stably fed into a container. To achieve this, in one preferred mode, a buffer is provided in a suction path connected to a suction pump. The buffer serves to prevent a gas-liquid separating membrane which allows a gas to pass through while hindering the passage of a liquid, from undergoing a pressure equal to or higher than the withstanding pressure of the membrane.

16 Claims, 24 Drawing Sheets

| PARAMETER | UNIT | VALUE |
|---|---|---|
| t:CALCULATED STEP TIME | [sec] | 0.005 |
| ts:SUCTION TIME | [sec] | 5 |
| WP:PUMP CAPACITY | [$cm^3$] | 0.38 |
| Vs:SUCTION SPEED | [$cm^3$/sec] | 0.076 |
| W0:SUCTION SYSTEM VOLUME | [$cm^3$] | 0.0375 |
| Rm:MEMBRANE VENTILATION COEFFICIENT | [$cm^3$/Pa/sec] | 2.96E-05 |
| Rt:SUPPLY SYSTEM SPEED COEFFICIENT | [$cm^3$/Pa/sec] | 2.6E-06 |
| Wsy0:Y TANK INITIAL SPACE | [$cm^3$] | 0.12 |
| Wsm0:M TANK INITIAL SPACE | [$cm^3$] | 0.06 |
| Wsc0:C TANK INITIAL SPACE | [$cm^3$] | 0.03 |
| Pty:Y INK BAG PRESSURE | [Pa] | 101325 |
| Ptm:M INK BAG PRESSURE | [Pa] | 101325 |
| Ptc:C INK BAG PRESSURE | [Pa] | 101325 |
| Plmt:PRESSURE VALVE SET VALUE | [Pa] | 0 |

FIG.6

| PARAMETER | UNIT | VALUE |
|---|---|---|
| t:CALCULATED STEP TIME | [sec] | 0.005 |
| ts:SUCTION TIME | [sec] | 5 |
| WP:PUMP CAPACITY | [$cm^3$] | 0.38 |
| Vs:SUCTION SPEED | [$cm^3$/sec] | 0.076 |
| W0:SUCTION SYSTEM VOLUME | [$cm^3$] | 0.0375 |
| Rm:MEMBRANE VENTILATION COEFFICIENT | [$cm^3$/Pa/sec] | 2.96E-05 |
| Rt:SUPPLY SYSTEM SPEED COEFFICIENT | [$cm^3$/Pa/sec] | 2.6E-06 |
| Wsy0:Y TANK INITIAL SPACE | [$cm^3$] | 0.12 |
| Wsm0:M TANK INITIAL SPACE | [$cm^3$] | 0.06 |
| Wsc0:C TANK INITIAL SPACE | [$cm^3$] | 0.03 |
| Pty:Y INK BAG PRESSURE | [Pa] | 101325 |
| Ptm:M INK BAG PRESSURE | [Pa] | 101325 |
| Ptc:C INK BAG PRESSURE | [Pa] | 101325 |
| Plmt:PRESSURE VALVE SET VALUE | [Pa] | 81315 |

FIG.10

| PARAMETER | UNIT | VALUE |
|---|---|---|
| t:CALCULATED STEP TIME | [sec] | 0.005 |
| ts:SUCTION TIME | [sec] | 5 |
| WP:PUMP CAPACITY | [$cm^3$] | 0.38 |
| Vs:SUCTION SPEED | [$cm^3$/sec] | 0.076 |
| W0:SUCTION SYSTEM VOLUME | [$cm^3$] | 1.9 |
| Rm:MEMBRANE VENTILATION COEFFICIENT | [$cm^3$/Pa/sec] | 2.96E-05 |
| Rt:SUPPLY SYSTEM SPEED COEFFICIENT | [$cm^3$/Pa/sec] | 2.6E-06 |
| Wsy0:Y TANK INITIAL SPACE | [$cm^3$] | 0.12 |
| Wsm0:M TANK INITIAL SPACE | [$cm^3$] | 0.06 |
| Wsc0:C TANK INITIAL SPACE | [$cm^3$] | 0.03 |
| Pty:Y INK BAG PRESSURE | [Pa] | 101325 |
| Ptm:M INK BAG PRESSURE | [Pa] | 101325 |
| Ptc:C INK BAG PRESSURE | [Pa] | 101325 |
| Plmt:PRESSURE VALVE SET VALUE | [Pa] | 0 |

FIG.14

| PARAMETER | UNIT | VALUE |
|---|---|---|
| t:CALCULATED STEP TIME | [sec] | 0.005 |
| ts:SUCTION TIME | [sec] | 0.5 |
| WP:PUMP CAPACITY | [$cm^3$] | 0.38 |
| Vs:SUCTION SPEED | [$cm^3$/sec] | 0.076 |
| W0:SUCTION SYSTEM VOLUME | [$cm^3$] | 1.9 |
| Rm:MEMBRANE VENTILATION COEFFICIENT | [$cm^3$/Pa/sec] | 2.96E-05 |
| Rt:SUPPLY SYSTEM SPEED COEFFICIENT | [$cm^3$/Pa/sec] | 2.6E-06 |
| Wsy0:Y TANK INITIAL SPACE | [$cm^3$] | 0.12 |
| Wsm0:M TANK INITIAL SPACE | [$cm^3$] | 0.06 |
| Wsc0:C TANK INITIAL SPACE | [$cm^3$] | 0.03 |
| Pty:Y INK BAG PRESSURE | [Pa] | 101325 |
| Ptm:M INK BAG PRESSURE | [Pa] | 101325 |
| Ptc:C INK BAG PRESSURE | [Pa] | 101325 |
| Plmt:PRESSURE VALVE SET VALUE | [Pa] | 0 |

FIG.18

LIQUID SUPPLY APPARATUS AND PRINTING APPARATUS

This application claims priority from Japanese Patent Application No. 2002-000168 filed Jan. 4, 2002, which is incorporated hereinto by reference.

BACKGROUND OF THE INVENTION

1. Field of the Invention

The present invention relates to a liquid supply apparatus that can supply a liquid to a container and a printing apparatus using this liquid supply apparatus.

2. Description of the Related Art

For conventional ink-jet printing apparatuses, many means for supplying ink to an ink-jet print head have been proposed and put to practical use. Serial scan ink-jet printing apparatuses employ various ink supplying means. The serial scan ink-jet printing apparatus has an ink-jet print head from which ink can be ejected and which is mounted on a carriage movable in a main scanning direction. In this case, an image is printed on a printing medium by performing an operation of ejecting ink from the print head on the basis of image data while moving the carriage in a main scanning direction together with the print head.

In these serial scan ink-jet printing apparatuses, the most classical supplying means is tube that is extended from ink tank in a printing apparatus main body to supply ink to the print head on the carriage. However, such tube supply means may cause ink to be unstably ejected because movement of the carriage affects the flow of ink through the tube in the direction in which the carriage moves. Thus, for printing apparatuses operating at increased printing speed, the behavior of ink through the tube must be controlled. Further, the tube must have a length corresponding to reciprocation of the carriage, so that the conventional supply means has various disadvantages. For example, to avoid problems resulting from the entry of air into the tube associated with the long-time storage of the printing apparatus, a large amount of ink may be allowed to flow through the tube from ink supply source such as ink tank during the initial period of use of the printing apparatus. In this case, the ink is wastefully consumed. Further, the tube simply form path through which ink is delivered from the ink tank to the ink-jet print head. Accordingly, in spite of that little added value, the tube has the various disadvantages of increasing the size of the printing apparatus and costs, complicating the structure, and the like.

In recent years, a so-called head tank on carriage method has been employed as an ink-jet printing apparatus that does not use the tube. With the head tank on carriage method, an ink-jet print head and ink tank are integrally or separable joined together, thus constituting a head cartridge (also referred to as an "ink-jet print head unit") 3 mounted on a carriage 4. The printing apparatus in FIG. 1 alternately repeats an operation of causing ink to be ejected from the print head on the basis of image data while moving the carriage 4 with the head cartridge 3 in the main scanning direction, shown by arrow A, and a transporting operation of transporting a printing medium 2 in a sub-scanning direction shown by arrow B and which crosses the main scanning direction. By alternate repeating these operations, an image is printed on the printing medium. Reference numeral 1 denotes a guide shaft on which the carriage 4 is guided so as to be movable in the main scanning direction. Reference numeral 8 denotes a cap that can cap ink ejection openings of the print head. The print head can execute a recovery process of maintaining a good ink ejection state by (preliminarily) ejecting ink that does not contribute to printing of images, to the interior of the cap 8. Further, a suction recovery process for maintaining a good ink ejection state can be executed by introducing negative pressure into the cap 8, which caps the ink ejection openings of the print head, and forcibly sucking and discharging ink through the ink ejection openings of the print head.

The print head may comprise, for example, an electrothermal converter to eject ink droplet through the ink ejection opening. That is, the electrothermal converter generates heat to subject ink to film boiling, so that the resulting bubbling energy can be utilized to eject ink droplet through the ink ejection opening.

With this ink supply operation based on the head tank on carriage method, ink supply path is formed between the print head and ink tank constituting the head cartridge 3. Accordingly, the configuration of the ink supply path is very simple. Further, the ink supply path is integrally contained in the print head or the ink tank, thus enabling the size of the apparatus and costs to be reduced. Furthermore, the ink supply path can be designed to be short and has a very small number of portions in which the direction in which they extend coincides with the movement direction of the carriage 4. This substantially prevents unstable ejection of ink attributed to the behavior of the ink during high-speed printing.

However, with the head tank on carriage method, a large amount of ink mounted in the carriage 3 results in an inevitable increase in the volume of the ink tank, constituting the head cartridge 3. This increases the weight of the entire carriage 4, on which the head cartridge 3 is mounted, increases the size of a motor acting as a drive source for the carriage 4, and increases a required drive current and the size and weight of the entire ink-jet printing apparatus.

On the other hand, for small-sized ink-jet printing apparatuses, since the size of the carriage is desired to be reduced, the capacity of the ink tank that can be mounted on the carriage is limited to an extremely small value. Thus, a user is forced to frequently replace the ink tank on the carriage with new one. Further, the frequent replacement of the ink tank is out of step with the current trend to strive to protect the environment.

A so-called pit-in method is means for solving these problems.

With the pit-in method, an ink-jet print head 11 and a sub-tank 6 are mounted on the carriage 4 guided on the guide shaft 1 as shown in FIG. 2. When ink supplied to the print head 11 from the sub-tank is consumed to reduce the amount of ink in the sub-tank 6 below a predetermined value, the carriage 4 moves to a predetermined home position as shown in FIG. 2. At the home position, ink from a main tank 7 is filled into the sub-tank 6, and then a printing operation is resumed. In the example in FIG. 2, a connecting member 18 on the side of the main tank 7 is connected to a hollow needle 14 on the side of the sub-tank 6 to fill ink from the main tank 7 into the sub-tank 6. The main tank 7 is provided with a bag 15 in which ink is accommodated. An ink supply path 16 composed of a channel constituting member including a flexible tube 17 is formed between the bag 15 and the connecting member 18. When ink is filled, a moving member 13 moves leftward in the figure along the direction of arrow "a" to join its arms 13A to the connecting member 18. Subsequently, the moving member 13 moves upward in the figure along the direction of arrow "b" to join the connecting member 18 to the hollow needle 14 on the side of the sub-tank 6.

The pit-in method serves to reduce the weight of the entire carriage 3, on which the print head 11 and the small-capacity sub-tank 6 are mounted, and to enable high-speed printing based on high-speed scanning. Further, since ink from the main tank 7 is filled into the sub-tank 6 at the home position, the number of printing medium 2 to be actually printed is not limited. Furthermore, no tube is required compared to the tube supply method, described previously, thus simplifying the configuration of the entire apparatus.

To complete the technique for the pit-in method, the most important technical point is to reliably fill the sub-tank 6 with ink. That is, for a pit-in period when the carriage 3 is moved to the home position to supply the sub-tank 6 with ink, the most important technique is how to supply ink from the main tank 7 to the sub-tank 6.

An example of such an ink supply technique is a method of providing a sensor that detects the amount of ink in the sub-tank 6, detecting, during the pit-in period, the amount of ink that can be supplied to the sub-tank 6, and on the basis of the result of the detection, controlling a supply system so that ink is supplied to the sub-tank 6. However, implementation of this method requires a very complicated, delicate, and expensive mechanism. A method for solving this problem comprises sucking all ink from the sub-tank 6 and subsequently injecting ink the amount of which equals the capacity of the sub-tank 6. However, although this method does not require any additional devices or mechanisms for detecting the amount of ink in the sub-tank 6, a large amount of waste ink must be sucked and discharged from the sub-tank 6. Thus, the size of a part in which waste ink is stored must be increased. In particular, if it is desirable to reduce the size of the ink-jet printing apparatus, its design is significantly restricted.

To solve these problems, a pit-in method using a gas-liquid separating membrane has been proposed.

FIGS. 3 and 4 are diagrams showing the pit-in method using a gas-liquid separating membrane. This method utilizes the nature of a gas-liquid separating membrane 23 that the membrane interrupts the flow of a liquid such as ink, while allowing a gas such as air to pass through. Before the carriage 4 moves to the home position for a pit-in operation, a sub-tank unit 20 on the side of the carriage 4 is separated from an ink supply recovery unit 21 on the side of the main tank which is provided at a specified position of the printing apparatus main body. In the sub-tank unit 20, an ink absorber 24 is provided in the sub-tank 6. Ink in the sub-tank 6 is supplied to an ink-jet print head 26 through a filter 25. Reference character L denotes the level of ink in the sub-tank 6. A suction path is formed in the upper part of the sub-tank 6 and is in communication with a suction receiving port 27 through the gas-liquid separating membrane 23. Reference numeral 22 denotes a hollow needle that is in communication with the sub-tank 6. Further, in the ink supply recovery unit 21, reference numeral 29 denotes a suction joint which can be connected to the suction receiving port 27 on the side of the unit 20 and which is connected to a suction pump (not shown) through a suction path. Reference numeral 30 denotes a supply joint which can be connected to the hollow needle 22 on the side of the unit 20 and which is connected to the main tank (not shown) through the ink supply path. The cap 8, which can cap the print head 26, is connected to an air communication path that is opened and closed by a valve body 28 and to the suction path connected to the suction pump.

During the pit-in period, the units 20 and 21 are joined together relatively close to each other. Ink from the unit 21 on the side of the main tank is supplied to the unit 20 on the side of the sub-tank 6. That is, as shown by the solid arrow in FIG. 4, the suction pump is used to suck air from the sub-tank 6 of the unit 20 through the suction joint 29, the suction receiving port 27, and the gas-liquid separating membrane 23. As a result, the negative pressure in the sub-tank 6 causes ink to be sucked from the main tank to the sub-tank 6 through the supply joint 30 and the hollow needle 22. When the level of the ink in the sub-tank 6 rises to the position of the gas-liquid separating membrane 23, the gas-liquid separating membrane 23 hinders the passage of the ink to automatically stop the ink supply. The amount of air sucked by the suction pump has only to be equal to or larger than the internal volume of the sub-tank 6. Irrespective of the amount of ink remaining in the sub-tank 6, the air in the sub-tank 6 is discharged through the gas-liquid separating membrane 23. Instead, ink from the main tank is supplied to the sub-tank 6.

Thus, to supply the sub-tank 6 with ink until the sub-tank 6 is full, a specified amount of air may be sucked from the sub-tank 6 through the gas-liquid separating membrane 23. Accordingly, it is unnecessary to control suction of air. Further, essentially, the sub-tank can be easily filled with ink by designing the suction pump so as to have a sufficient margin.

However, implementation of such an ink supply is restricted by the physical properties of the gas-liquid separating membrane. This problem will be described below.

Typically, various pumps are applied to the ink-jet printing apparatus. In the ink-jet printing apparatus based on the pit-in method and using the gas-liquid separating membrane, the suction pump is deployed to fill ink into the sub-tank as described above. Such suction pumps include a classical syringe pump, which is reliable and allows the amount of ink sucked to be precisely set. The syringe pump allows the amount of ink sucked to be precisely set without controlling parameters such as drive time and speed. Further, as such a suction pump, a classical pump called a "roller pump" (or "tube pump") is also frequently employed. The roller pump is characterized by freely performing a sucking operation using the drive time and speed as parameters. However, the drive time and speed must be strictly controlled in order to allow the amount of ink sucked to be precisely set. Most of the suction pumps employed for the pit-in method using the gas-liquid separating membrane are syringe pumps. This is because the syringe pump is relatively compact and allows the amount of ink sucked to be precisely set.

Further, with the pit-in method using the gas-liquid separating membrane, the sub-tank is filled with ink by sucking air from the sub-tank through the gas-liquid separating membrane with a predetermined margin. When filled with the ink, the sub-tank contains ink the amount of which equals the difference between the amount of ink required to previously fill the sub-tank and the amount of ink subsequently used.

Description will be given below of the results of simulation of the relationship between the waveform of pressure exerted by the suction pump, differential pressure exerted on the gas-liquid separating membrane, and ink filling time in the case where ink is filled into the sub-tank, in which ink remains.

FIG. 5 is a schematic diagram of a pit-in method using a gas-liquid separating membrane which method was used in the simulation. The main tank 7 on the side of the ink supply recovery unit 21 comprises tanks for yellow ink (Y), magenta ink (M), and cyan ink (C). These main tanks are connected to the corresponding supply joints 30 via individual ink supply paths 34. Similarly, the sub-tank 6 comprises tanks for yellow ink (Y), magenta ink (M), and cyan ink (C). These sub-tanks 6 are each provided with the hollow needle 22, which can be connected to the corresponding supply joint 30. The sub-tanks 6 are connected to the common suction receiving port 27 via the respective gas-liquid separating membranes 23.

FIG. 5 shows a condition in which the suction receiving port 27 is connected to the suction joint 29 while the hollow needle 22 is connected to the supply joint 30 so as to supply ink to the ink absorber 24 in the sub-tank 6. That is, as shown by the solid arrow in the figure, suction force exerted by a suction pump 31 causes air to be sucked from each sub-tank 6 through the gas-liquid separating membranes 23. As shown by the dotted line in the figure, ink from each main tank 7 is fed into the corresponding sub-tank 6. Reference numeral 33 denotes a suction path formed between the gas-liquid separating membranes 23 and the suction pump 31. In the suction path 33, a pressure valve 35 is provided between the suction pump 31 and the supply joint 29. The pressure valve can function as an open valve, described later.

Parameters used for the simulation in this example include the internal pressure Pt [Pa] of the main tank 7, the easiness with which ink flows through the ink supply path 34 (the inverse of flow resistance) Rt [$cm^3$/Pa/sec], the maximum capacity Wp [$cm^3$] of the suction pump 31, the suction speed Vs [$cm^3$/sec] of the suction pump 31, the permeability Rm [Pa/$cm^3$/sec] of the gas-liquid separating membrane 23, the volume W0 [$cm^3$] of the suction path 33, the ink supply capacity Ws [$cm^3$] of the sub-tank 6, and the operating pressure Plmt [Pa] of the pressure valve 35.

FIGS. 6 to 9 are a table and graphs illustrating the parameters and results of the simulation that used the configuration in FIG. 4.

FIG. 6 shows the simulation parameters used in this example. FIG. 7 shows the waveform of pressure exerted on the suction path 33 for the suction pump 31 in FIG. 6. FIG. 8 shows the differential pressure exerted on the gas-liquid separating membrane 23. FIG. 9 shows the results of the simulation in terms of the amount of ink filled. In these figures, reference characters Y, M, and C mean the relationships with a yellow, magenta, cyan ink supply systems, respectively.

In this example, at the start of the simulation, the amounts of spaces in the sub-tanks 6 (as the amount of space decreases, the sub-tank is closer to its full state) are unbalanced in order to indicate the behavior of each ink color. The manners in which ink remains in the sub-tanks 6 for the respective ink colors, i.e. the amounts of spaces in the sub-tanks 6 for the respective ink colors can be combined together in an infinite number of ways. This example is only illustrative. As described previously, the gas-liquid separating membrane 23 allows air sucked by the suction pump 31 to pass through, while inhibiting the passage of ink. Thus, when ink is filled into each of the sub-tanks 6 for the respective colors until it reaches the gas-liquid separating membrane 23, the ink filling operation is automatically stopped. Accordingly, for the sub-tanks 6 for the respective ink colors, the ink filling operation is stopped first in the first sub-tank to be filled with ink, second in the second sub-tank to be filled with tank, . . . .

The suction pump 31 continues operation until a predetermined amount of ink has been sucked, even if the sub-tank 6 is full of ink. Thus, as shown in FIG. 7, after the filling operation has been completed in the sub-tanks 6 for yellow ink (Y), magenta ink (M), and cyan ink (C), even if the pressures (Yst, Mst, and Cst) in these sub-tanks decrease, the pressure (Pc) in a suction system of the suction pump 31 continues increasing. In this example, the amount of space is larger in the sub-tank 6 for the yellow ink (Y) than in the sub-tank 6 for the magenta ink (M), and is larger in the sub-tank 6 for the magenta ink (M) than in the sub-tank 6 for the cyan ink (C). Accordingly, the sub-tanks 6 are filled with ink in the reverse order (the order of C, M, and Y). The amounts ($\Sigma vi[C]$, $\Sigma vi[M]$, and $\Sigma vi[Y]$)of ink injected into the sub-tanks 6 are as shown in FIG. 9. Thus, the suction pressure in the suction pump 31 continues increasing even after all sub-tanks 6 have been filled with ink. Consequently, as shown in FIG. 8, there occurs a large difference between the pressure in the sub-tanks 6 and the pressure in the suction path 33 on the side of the suction pump 31, the sub-tanks 6 and the suction path 33 being separated by the gas-liquid separating membranes 23.

However, the gas-liquid separating membrane 23 normally has a withstanding pressure limit Pm (Pm<P0 (P0 is the atmospheric pressure)). Accordingly, if differential pressure exceeding this limit is applied, ink may leak through the gas-liquid separating membrane 23. Further, the gas-liquid separating membrane 23 is a porous member in which gas-liquid separating action is caused by capillary force (meniscus force) resulting from the contact between very small holes and ink. Thus, the size of meniscus and the withstanding pressure increase with decreasing hole diameter. On the other hand, permeability (also expressed by a Gurley value) is degraded.

The gas-liquid separating membrane 23 made of PTFE (polytetrafluoroethylene), which has an ink pressure resistance and a practical permeability, has a pore size of 0.1 to 1 $\mu$m and an ink pressure resistance of about $1\times10^5$ Pa (1 atm). However, in view of repeated pit-in operations (ink filling operations), a normally allowable design load pressure requires a sufficient margin for the withstanding pressure of the gas-liquid separating membrane 23. Studies conducted by the inventor indicate that a suitable range of load pressure is specifically between 20,000 and 70,000 Pa. The results of the simulation in FIG. 8 indicate that an excessive differential pressure is exerted on the gas-liquid separating membrane 23. Accordingly, in designing a pit-in method using a gas-liquid separating membrane, it is necessary to rigorously regulate the difference in pressure between the suction pump and the interior of the sub-tank.

To deal with this problem, it is contemplated that the pressure valve 35 (see FIG. 5) provided on the side of the suction pump may function as an open valve. FIGS. 10 to 13 are a table and graphs illustrating the parameters and results of simulation in which such an open valve is provided.

In this example, the parameters for the open valve were set so that the valve operated when the differential pressure in an intake air system had a pressure of 20,000 Pa (81,315 Pa because the parameters of this simulation are based on absolute pressure). As a result, the open valve operates in response to the differential pressure between the open air and the suction path 33, so that no excessive differential pressures are exerted on the gas-liquid separating membrane, as shown in FIGS. 11 to 13. Further, even if the open valve is used to control the pressure, the time required to fill the sub-tank with ink is not significantly affected as shown in FIG. 11. However, it is technically difficult to manufacture small and inexpensive open valves (leak valves) performing stable operating reliably in response to a pressure of several tens of thousand Pa.

As described above, with a pit-in supply method using a gas-liquid separating membrane, if an open valve is used to reduce the suction pressure below the withstanding pressure of the gas-liquid separating membrane, it is technically difficult to design a small and inexpensive open valve performing a stable operating. Further, such an open valve does not contribute substantially in spite of investment in this design.

SUMMARY OF THE INVENTION

It is an object of the present invention to provide a liquid supply apparatus which uses a simple configuration to reliably prevent a gas-liquid separating membrane which allows a gas to pass through while hindering the passage of a liquid, from undergoing a pressure equal to or higher than the withstanding pressure of the membrane, thus enabling a liquid to be stably fed into a container, as well as a printing apparatus using this liquid supply apparatus.

There is provided a liquid supply apparatus using a gas-liquid separating membrane that allows a gas to pass through while inhibiting passage of a liquid so that a suction pump can be used to suck air from a container via the gas-liquid separating membrane and a suction path, wherein the suction path is provided with a buffer space that reduces maximum differential pressure exerted on the gas-liquid separating membrane, below a withstanding pressure of the gas-liquid separating membrane.

According to the present invention, the predetermined buffer space is formed in the suction path connected to the suction pump. This simple configuration prevents the gas-liquid separating membrane which allows a gas to pass through while hindering the passage of a liquid, from undergoing a pressure equal to or higher than the withstanding pressure of the membrane, thus enabling a liquid to be stably fed into a container.

Further, in particular, when the present invention is applied to an ink-jet printing apparatus based on a pit-in method using a gas-liquid separating membrane, ink can be stably supplied while reducing the size and costs of the printing apparatus.

The above and other objects, effects, features and advantages of the present invention will become more apparent from the following description of embodiments thereof taken in conjunction with the accompanying drawings.

BRIEF DESCRIPTION OF THE DRAWINGS

FIG. 6 is a table illustrating simulation parameters for the ink supply system in FIG. 5;

FIG. 10 is a table illustrating another example of simulation parameters for the ink supply system in FIG. 5;

FIG. 14 is a table illustrating simulation parameters according to a first embodiment of the present invention;

FIG. 18 is a table illustrating simulation parameters according to a second embodiment of the present invention;

DETAILED DESCRIPTION OF THE PREFERRED EMBODIMENTS

Embodiments of the present invention will be described below with reference to the drawings.

(First Embodiment)

Figure 1:
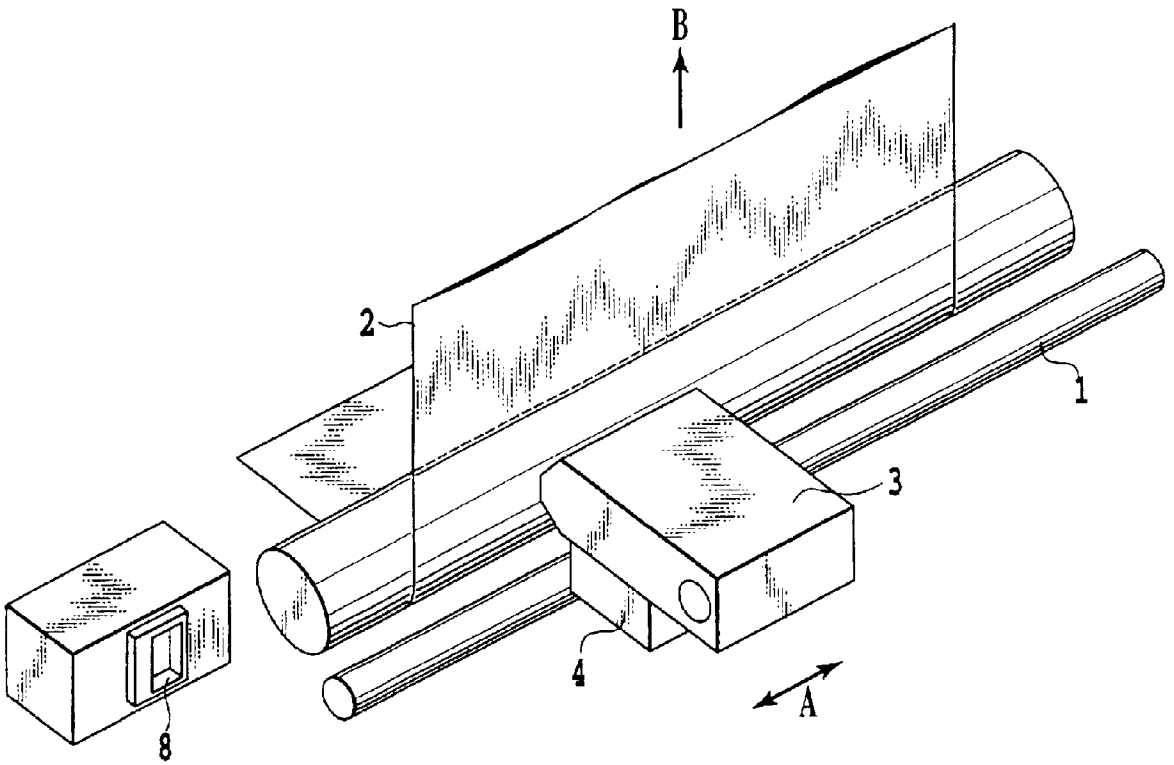
FIG. 1 is a perspective view of an essential part of an ink-jet printing apparatus based on a head tank on carriage method.
Figure 2:
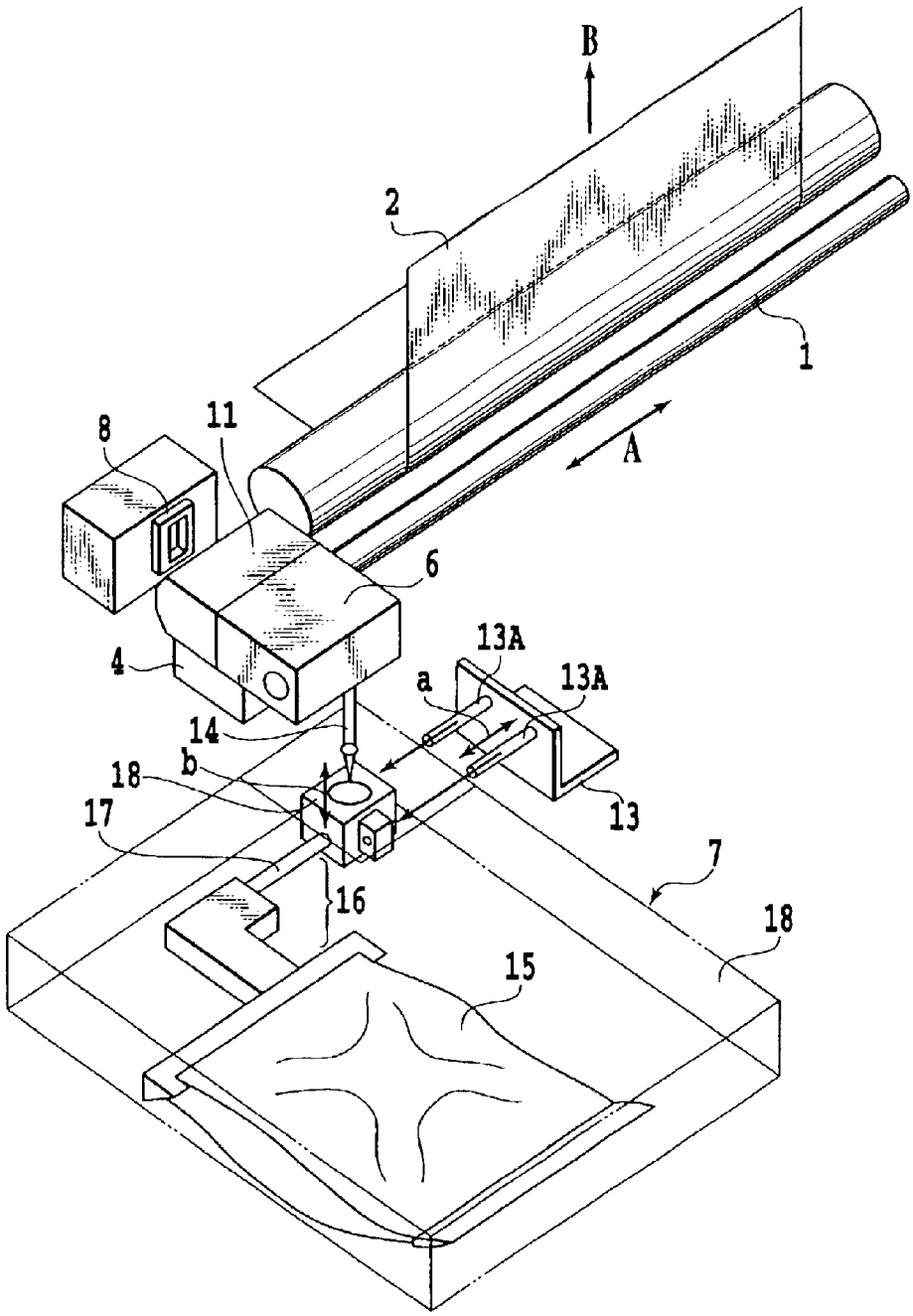
FIG. 2 is a perspective view of an essential part of an ink-jet printing apparatus based on a pit-in method.
Figure 3:
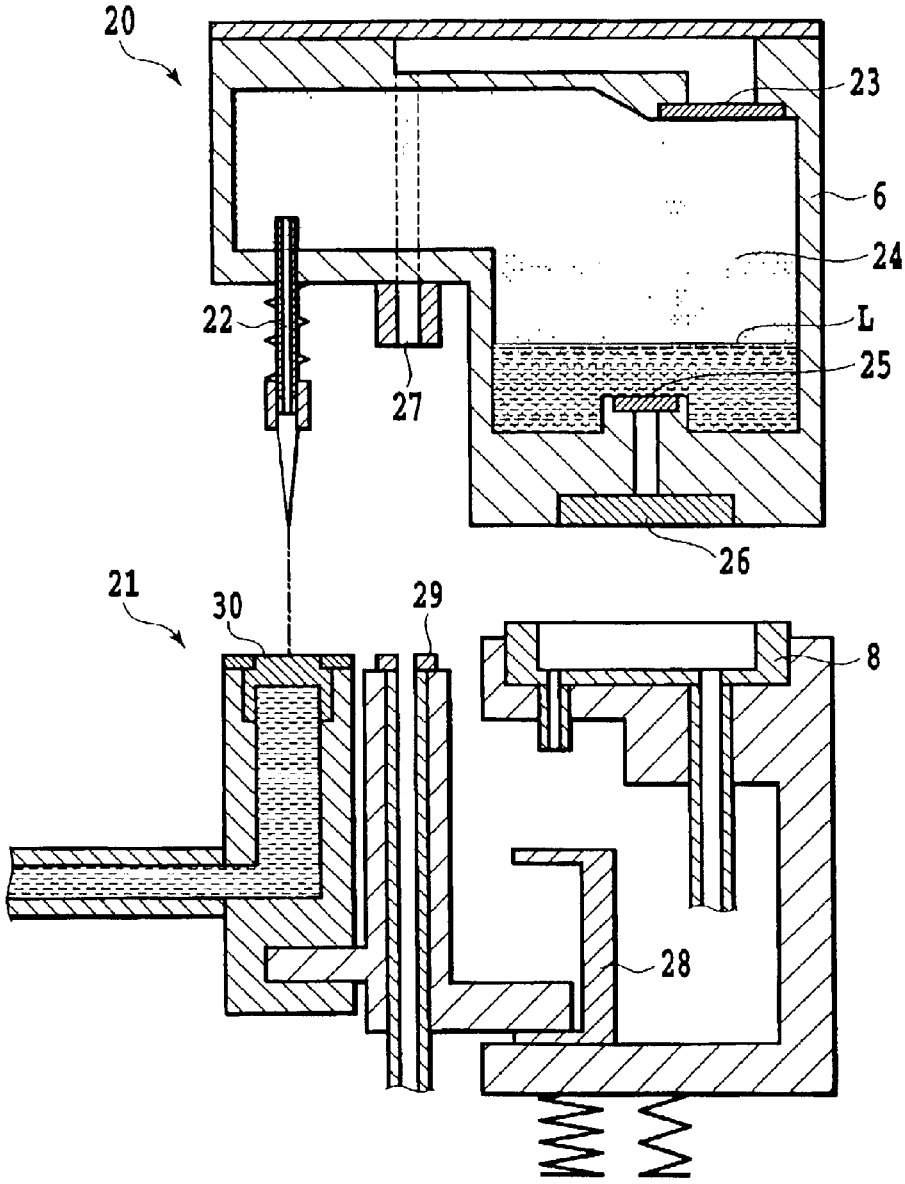
FIG. 3 is a sectional view of the state of the ink-jet printing apparatus based on the pit-in method, prior to a pit-in period.
Figure 4:
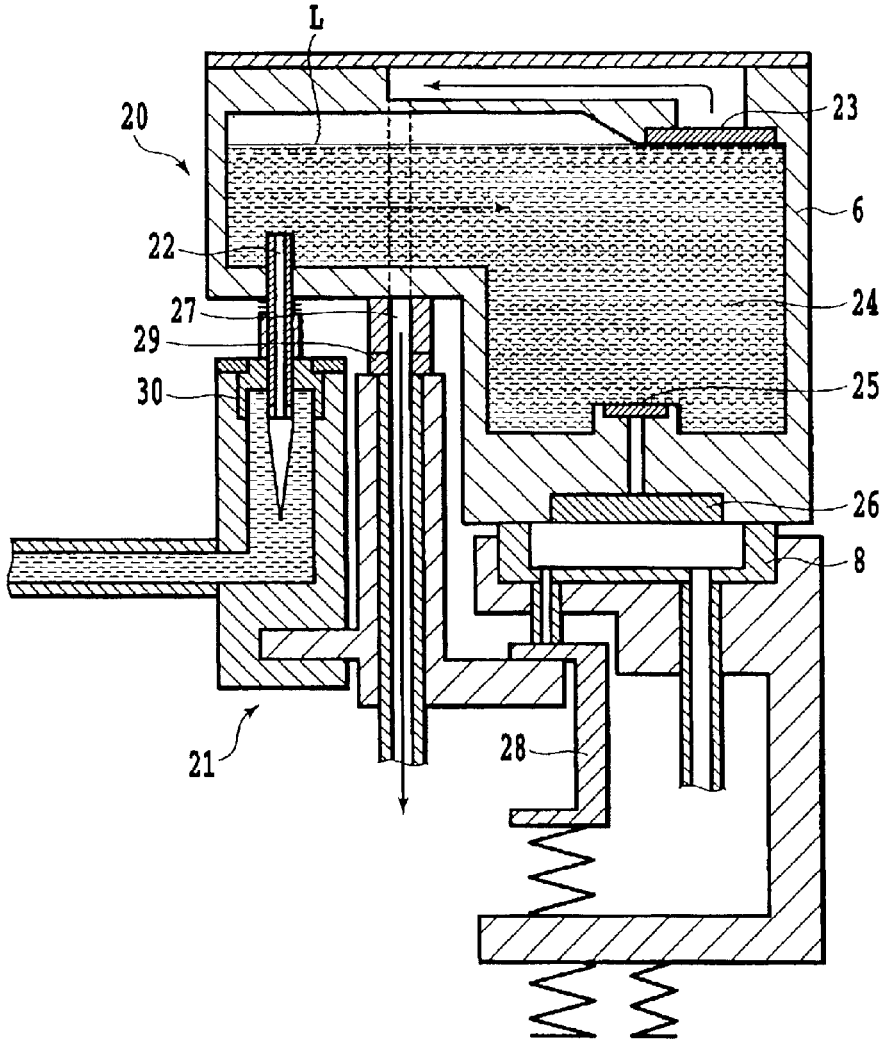
FIG. 4 is a sectional view of the state of the ink-jet printing apparatus in FIG. 3 during the pit-in period.
Figure 5:
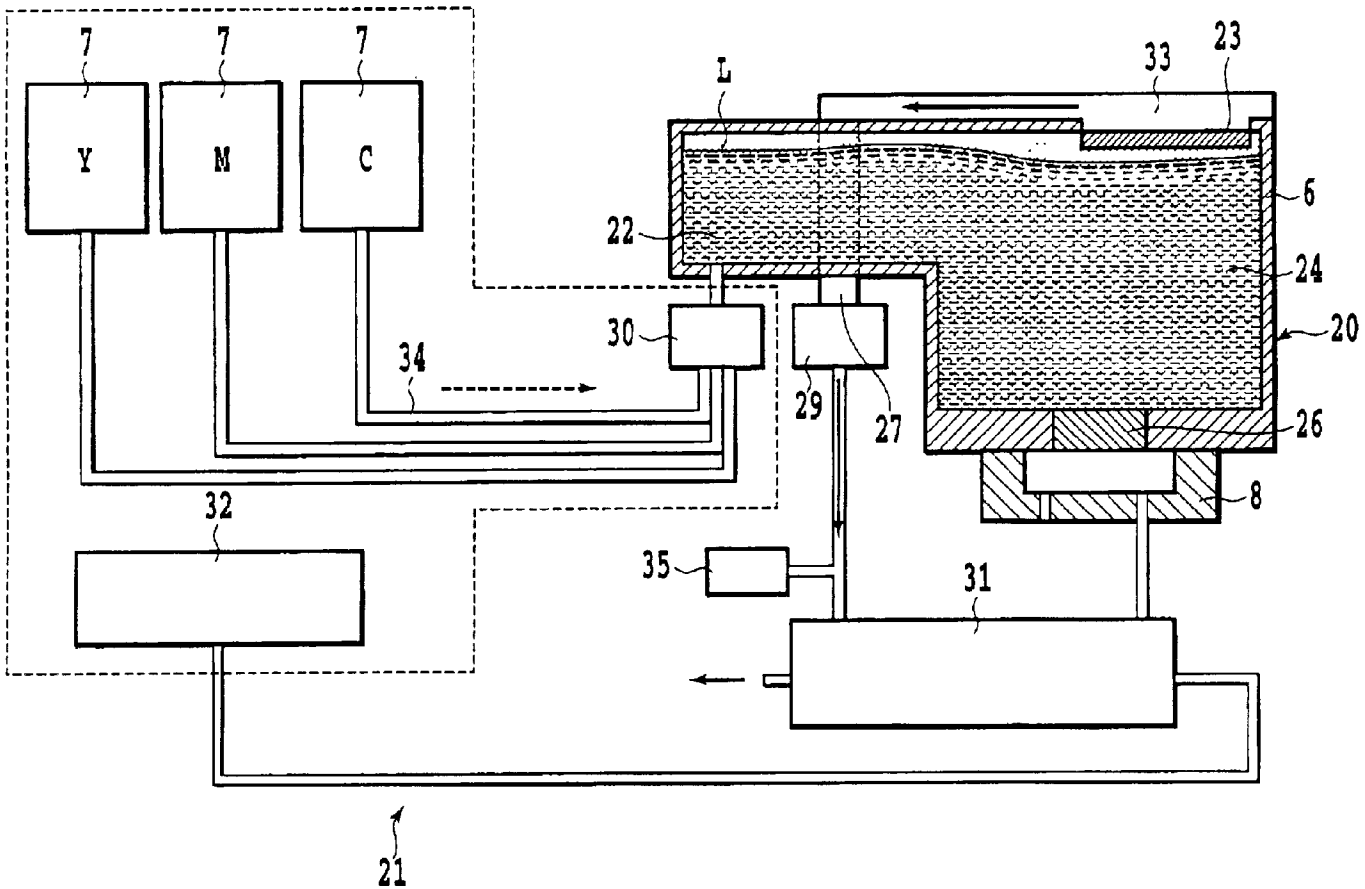
FIG. 5 is a schematic diagram illustrating the configuration of a conventional example of an ink supply system of the ink-jet printing apparatus based on the pit-in method.
Figure 7:
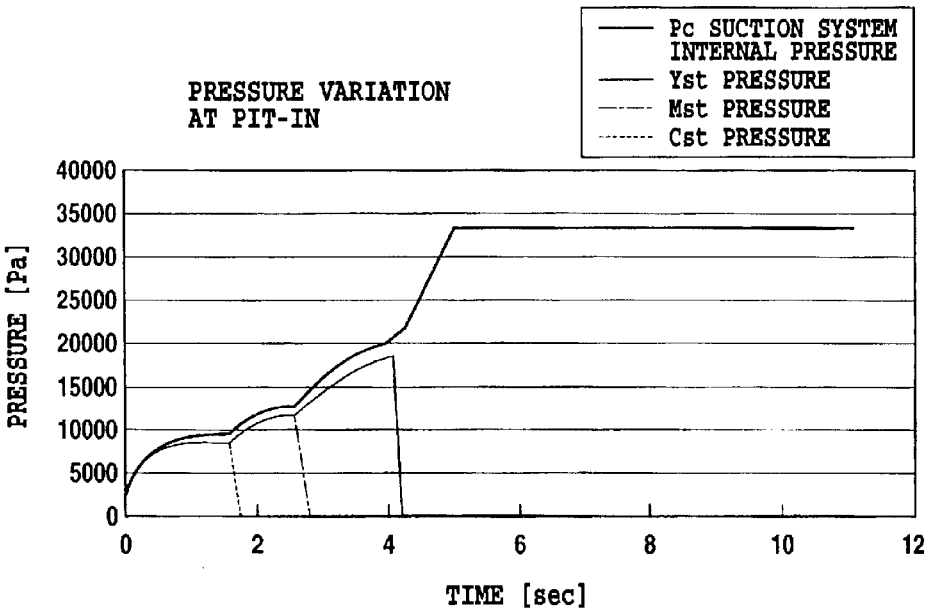
FIG. 7 is a graph illustrating a variation in the pressure in the ink supply system in FIG. 5.
Figure 8:
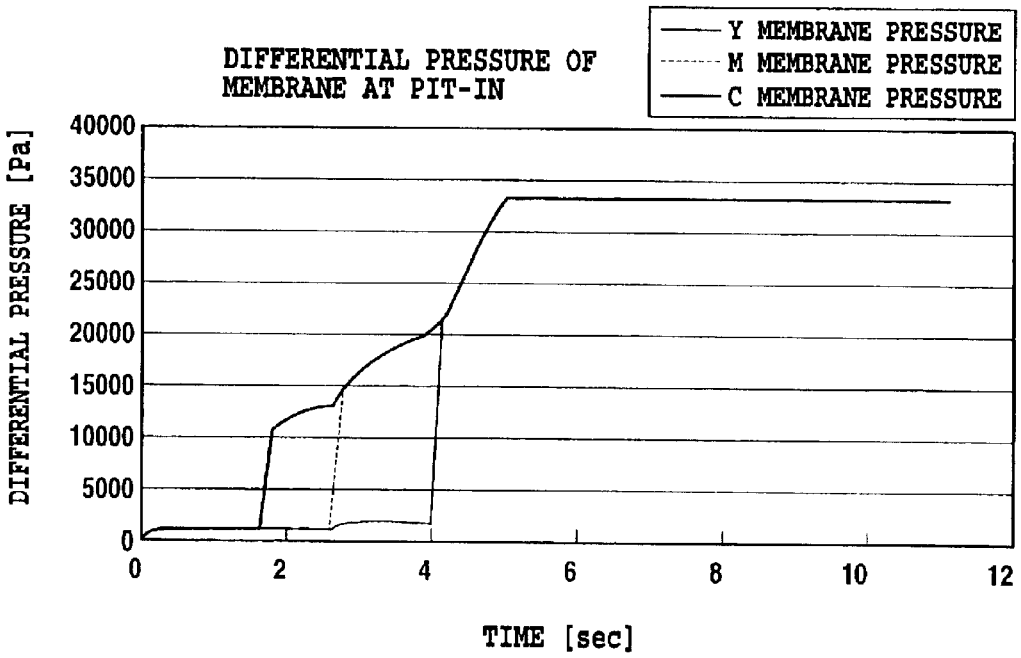
FIG. 8 is a graph illustrating differential pressure exerted on a gas-liquid separating membrane in the ink supply system in FIG. 5.
Figure 9:
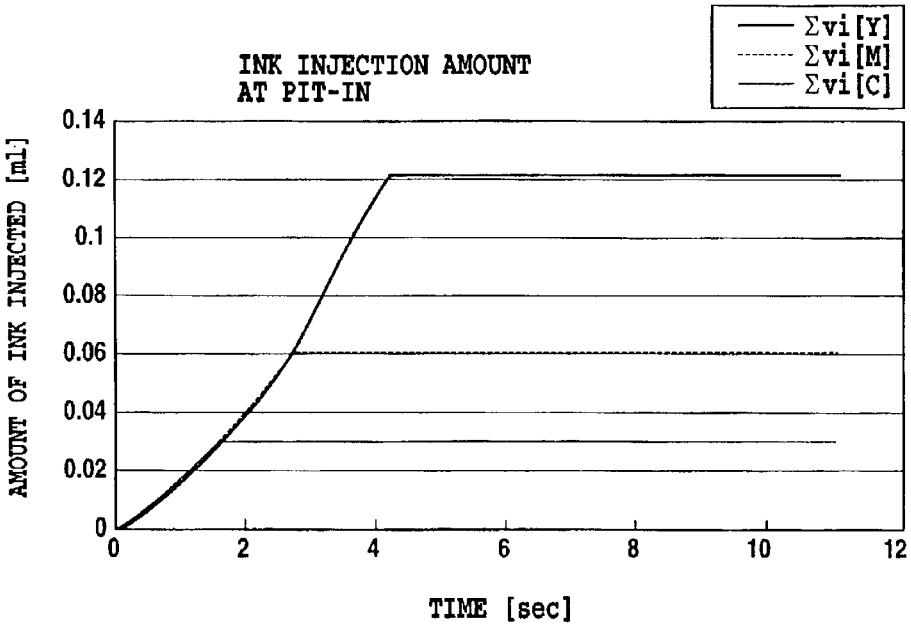
FIG. 9 is a graph illustrating the amount of ink injected by the ink supply system in FIG. 5.
Figure 11:
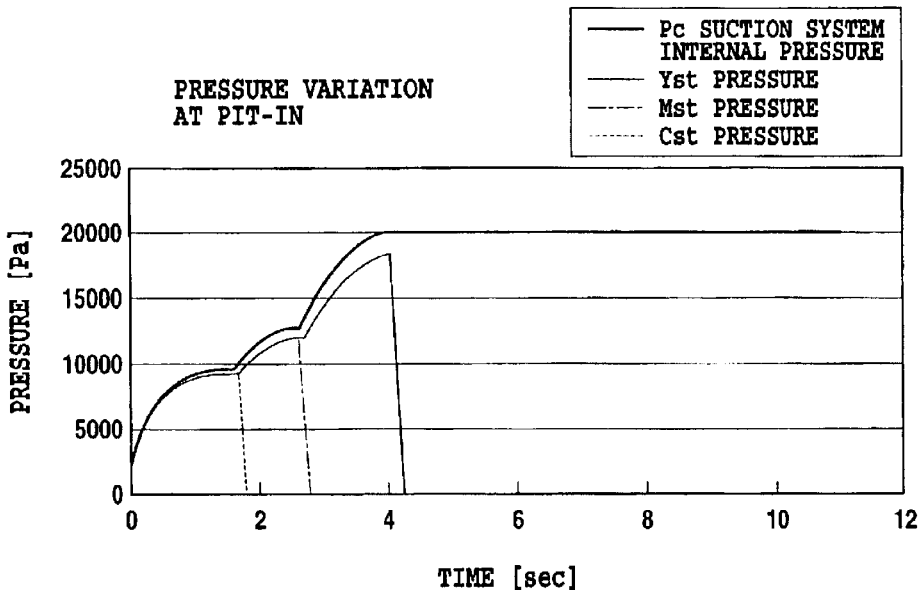
FIG. 11 is a graph illustrating a variation in pressure which occurs when the simulation parameters in FIG. 10 are set.
Figure 12:
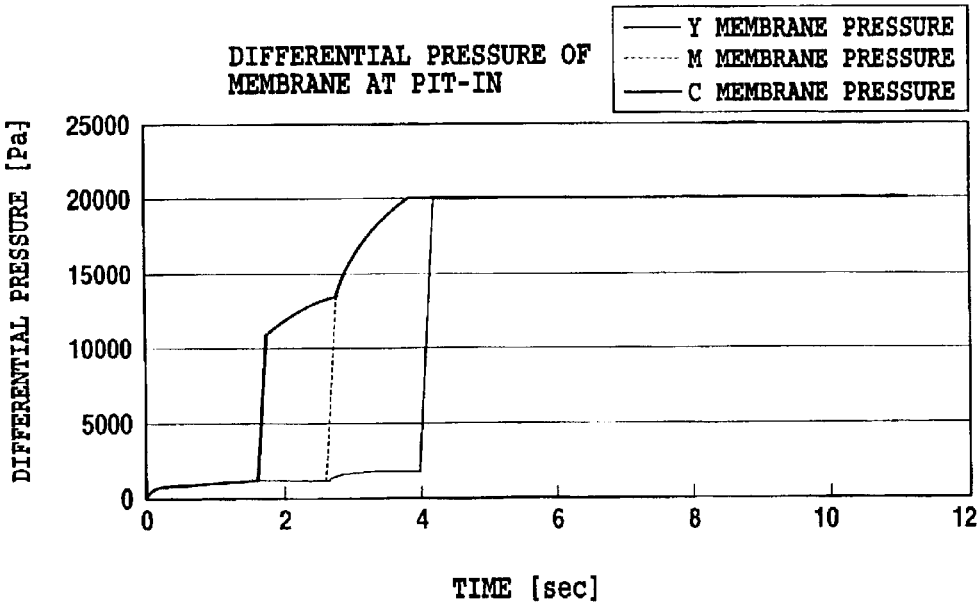
FIG. 12 is a graph illustrating differential pressure exerted on the gas-liquid separating membrane when the simulation parameters in FIG. 10 are set.
Figure 13:
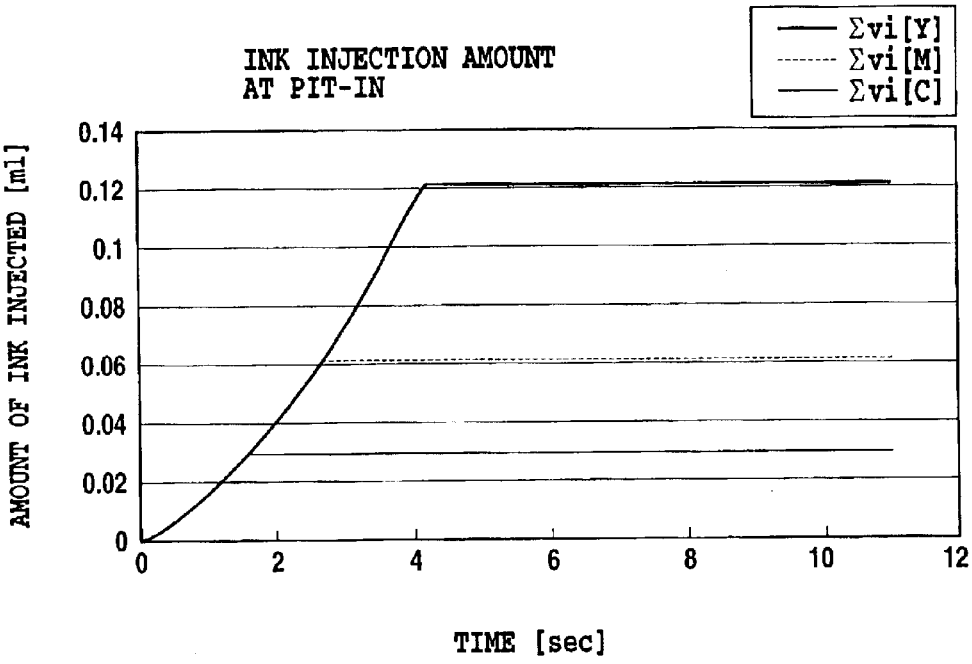
FIG. 13 is a graph illustrating the amount of ink injected when the simulation parameters in FIG. 10 are set.
Figure 15:
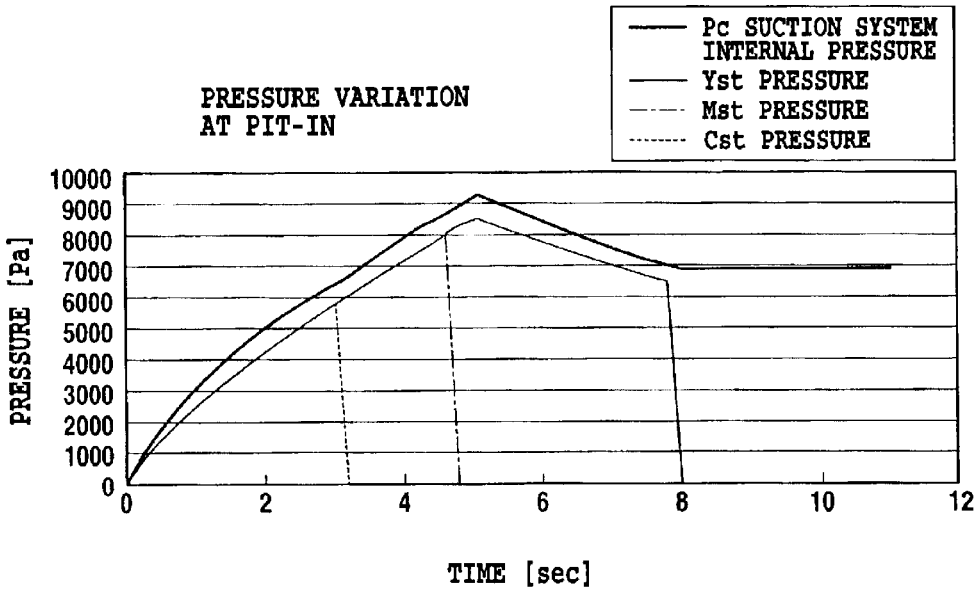
FIG. 15 is a graph illustrating a variation in pressure which occurs when the simulation parameters in FIG. 14 are set.
Figure 16:
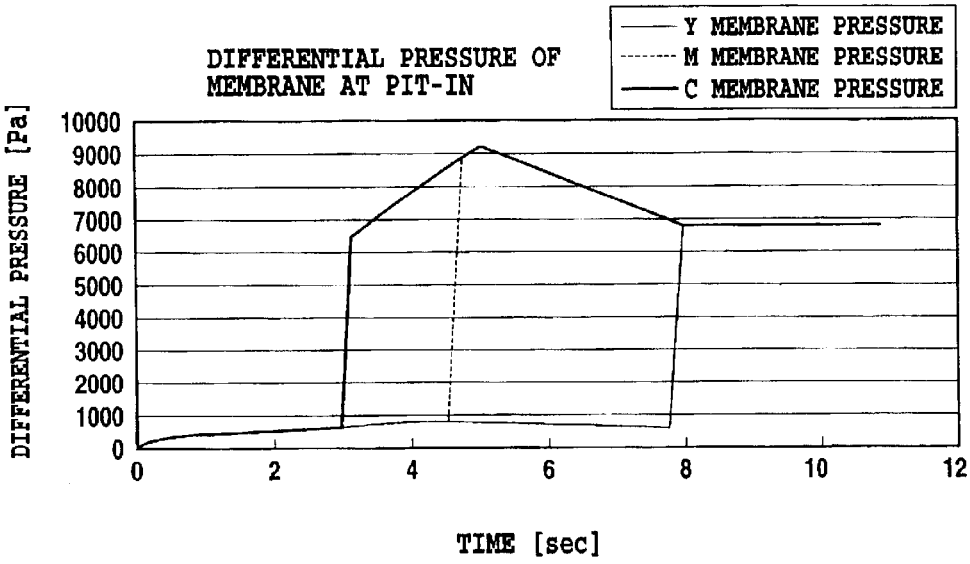
FIG. 16 is a graph illustrating differential pressure exerted on the gas-liquid separating membrane when the simulation parameters in FIG. 14 are set.
Figure 17:
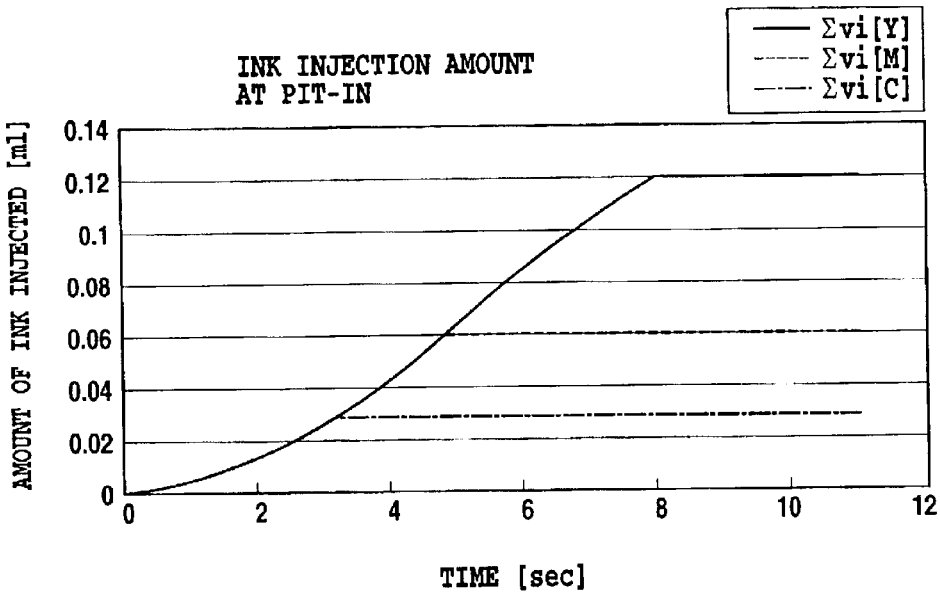
FIG. 17 is a graph illustrating the amount of ink injected when the simulation parameters in FIG. 14 are set.

FIGS. 14 to 17 illustrate a first embodiment of the present invention. In this example, a basic configuration for implementing ink supply based on a pit-in method using a gas-liquid separating membrane is similar to the configuration in FIG. 5, described previously, except that the pressure valve 35 has been eliminated. FIG. 14 is a table illustrating parameters used for simulation carried out in this example. FIGS. 15 to 17 illustrate the results of the simulation.

In this example, the volume W0 of the suction path (see FIG. 5) is changed. Specifically, the volume W0 is set so as to establish the relationship in:

$$(W0+WP\max)/W0 \leq P0-Pm \quad (1)$$

where reference character Pm denotes the withstanding pressure of the gas-liquid separating membrane 23, reference character P0 denotes the atmospheric pressure, and Pm<P0. Further, reference character WPmax denotes the maximum suction volume of the suction pump 31.

The gas-liquid separating membrane 23 has a withstanding pressure of 20,000 Pa. The parameters in FIG. 14 illustrate that in this example, the pressure valve 35 in FIG. 10 is eliminated and that the parameters other than the volume W0 have the values in FIGS. 6 and 10.

By setting the volume W0 of the suction path 33 so as to establish the relationship in Equation (1), a buffer space is formed in the suction path 33 to keep the pressure exerted on the gas-liquid separating membrane 23, equal to or lower than the with standing pressure Pm. As a result, as shown in FIG. 16, the pressure exerted on the gas-liquid separating membrane 23 does not exceed the withstanding pressure Pm. Further, as shown in FIG. 17, the time required to fill the sub-tank with ink increases slightly.

(Second Embodiment)

FIGS. 18 to 21 illustrate a second embodiment of the present invention. This example corresponds to the first embodiment, described previously, in which an attempt is made to reduce the ink filling time.

Figure 19:
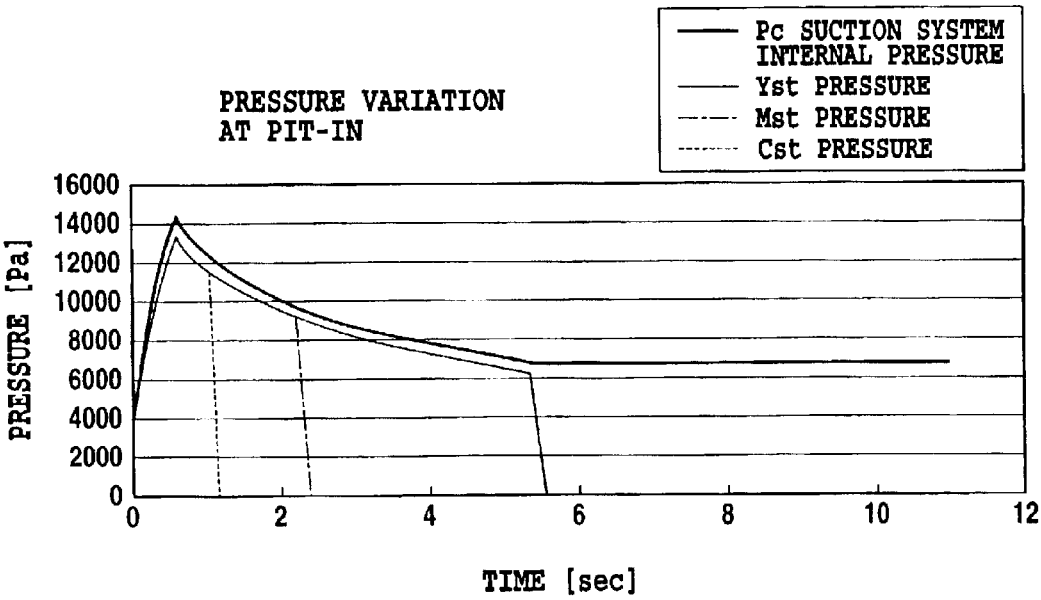
FIG. 19 is a graph illustrating a variation in pressure which occurs when the simulation parameters in FIG. 18 are set.
Figure 20:
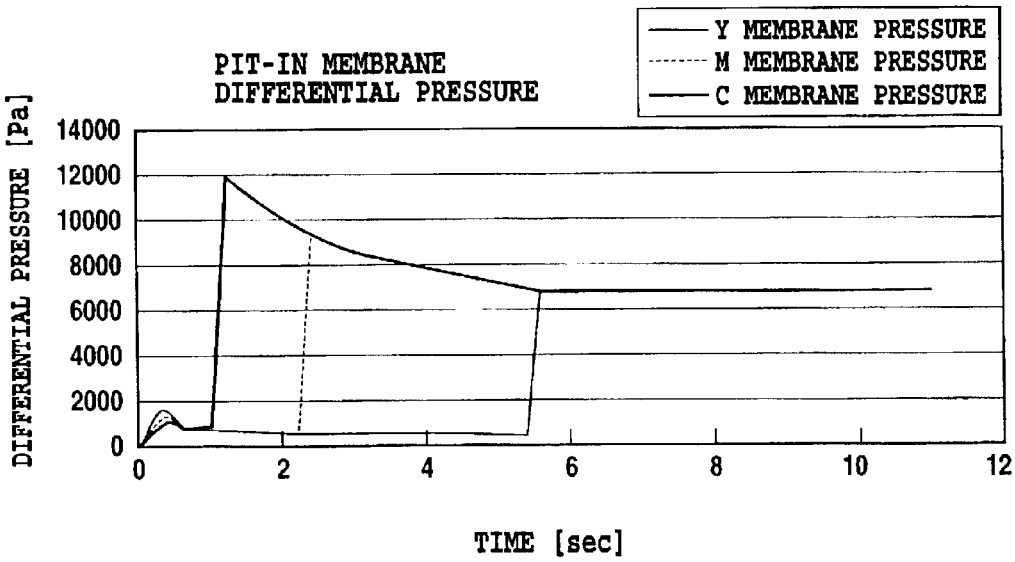
FIG. 20 is a graph illustrating differential pressure exerted on the gas-liquid separating membrane when the simulation parameters in FIG. 18 are set.
Figure 21:
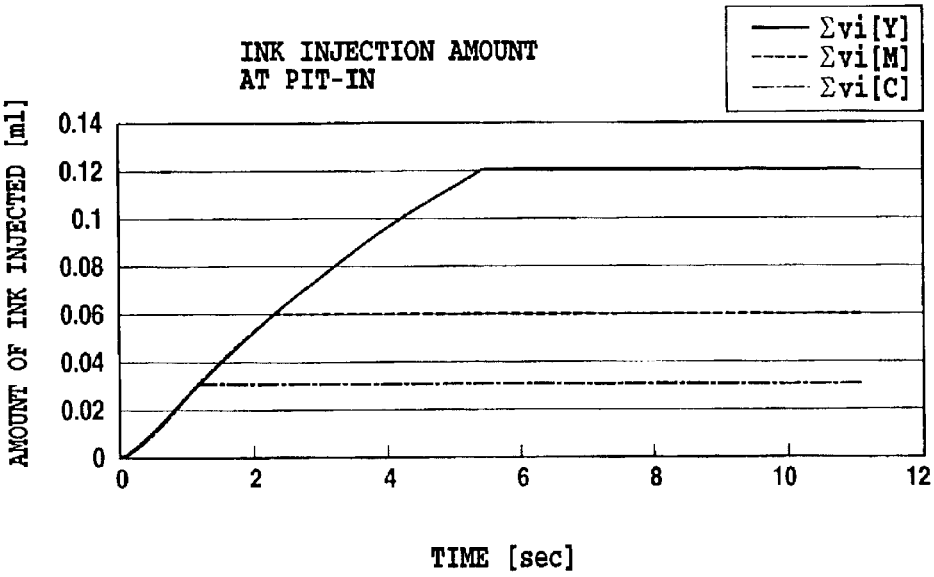
FIG. 21 is a graph illustrating the amount of ink injected when the simulation parameters in FIG. 18 are set.

In this example, the suction speed Vs of the suction pump 31 is changed while maintaining the relationship in Equation (1), described above. The other arrangements are similar to those of the first embodiment, described previously. FIG. 18 illustrates parameters used for simulation carried out in this example. FIGS. 19 to 21 illustrate the results of the simulation.

In this example, as indicated by the parameters in FIG. 18, the suction speed Vs is increased above that in the first embodiment, described previously. The other parameters are similar to those in the first embodiment, described previously. As a result, as shown in FIG. 20, the pressure exerted on the gas-liquid separating membrane 23 does not exceed the withstanding pressure Pm as in the case with the first embodiment. Further, since the suction speed Vs is increased compared to the first embodiment, the ink filling time decreases as shown in FIG. 21. If the ink fitting time is restricted, this restriction is eliminated. That is, in this example, ink filling speed can be sufficiently increased to achieve a stable ink filling operation without using an open valve which requires high costs and which is technically difficult to realize and without exerting differential pressure on the gas-liquid separating membrane 23 which pressure exceeds the withstanding pressure of the membrane 23.

(Third Embodiment)

Figure 22:
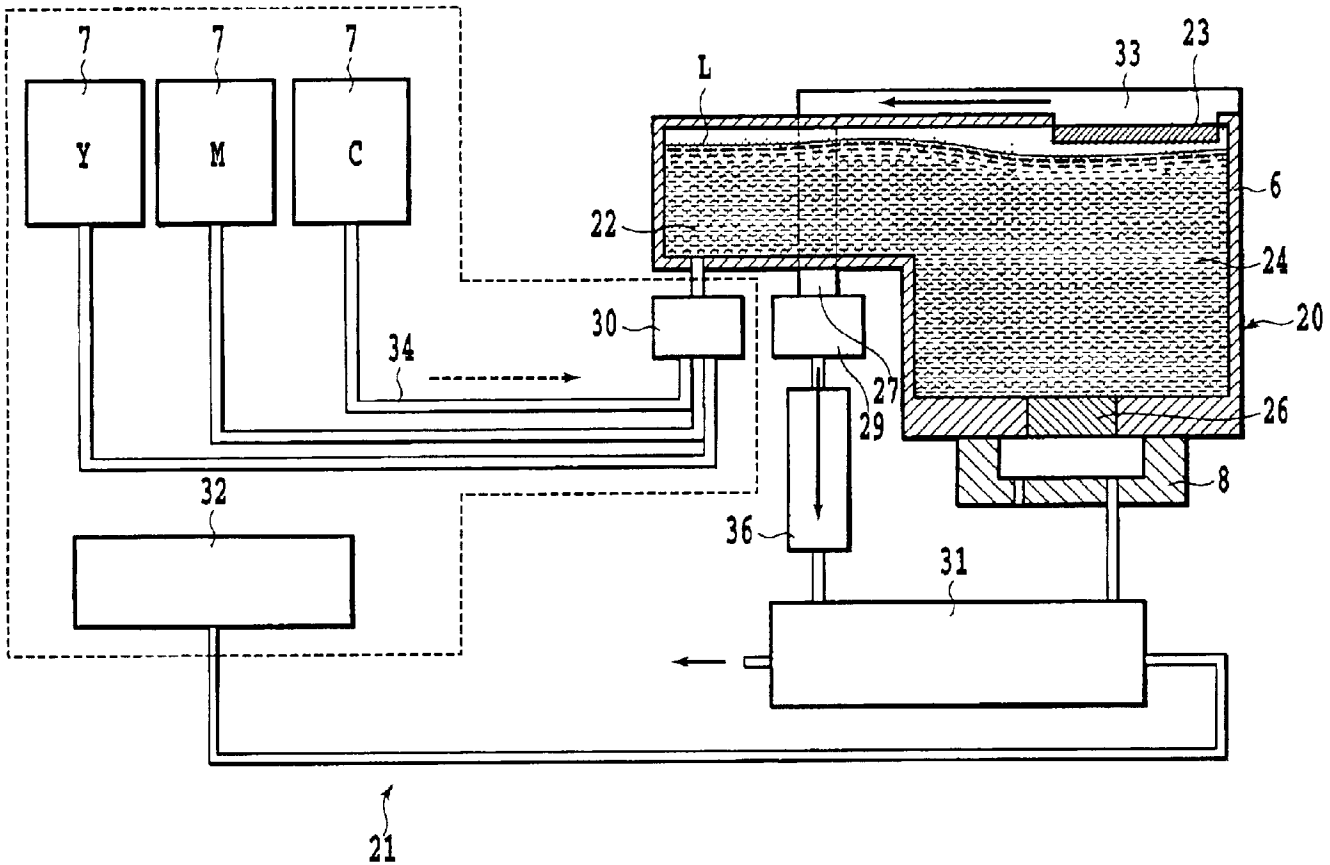
FIG. 22 is a schematic diagram illustrating the configuration of an ink supply system according to a third embodiment of the present invention.

FIG. 22 illustrates a third embodiment of the present invention. Parts similar to those in FIG. 5, described previously, are denoted by the same reference numerals. Their description is omitted.

The suction path 33 of the suction pump 31 may partly or wholly have an increased inner diameter in order to set the volume of the suction path 33 so as to establish Equation (1), described above. In this example, a buffer 36 having a large inner diameter is provided in the suction path 33 between the suction joint 29 and the suction pump 31. Thus, when the inner diameter of part or whole of the suction path 33 is increased to set the volume of the suction path 33 so as to meet the relationship in Equation (1), the resulting configuration is very simple and allows many requirements to be met as long as there are no special design restrictions.

(Fourth Embodiment)

Figure 23:
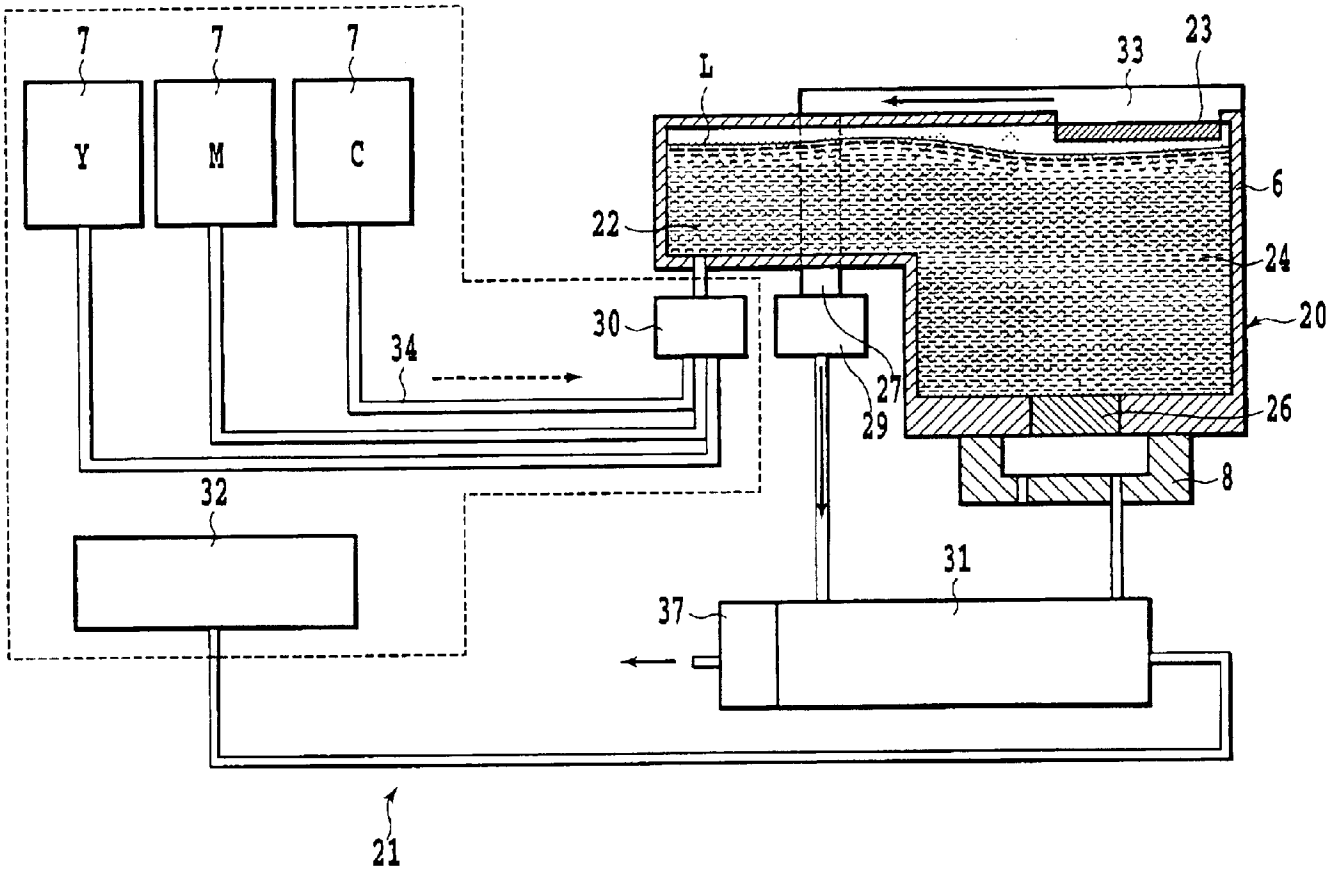
FIG. 23 is a schematic diagram illustrating the configuration of an ink supply system according to a fourth embodiment of the present invention.

FIG. 23 illustrates a fourth embodiment of the present invention. Parts similar to those in FIG. 5, described previously, are denoted by the same reference numerals. Their description is omitted.

In this example, a buffer 37 is formed in the syringe type suction pump 31 as an area that does not function as pump, in order to set the volume of the suction path 33 so as to establish the relationship in Equation (1), described above. In this example, an extra space around the suction pump 31 can be utilized to form the buffer 37. This serves to simplify the configuration and to reduce the price of the apparatus.

(Fifth Embodiment)

Figure 24:
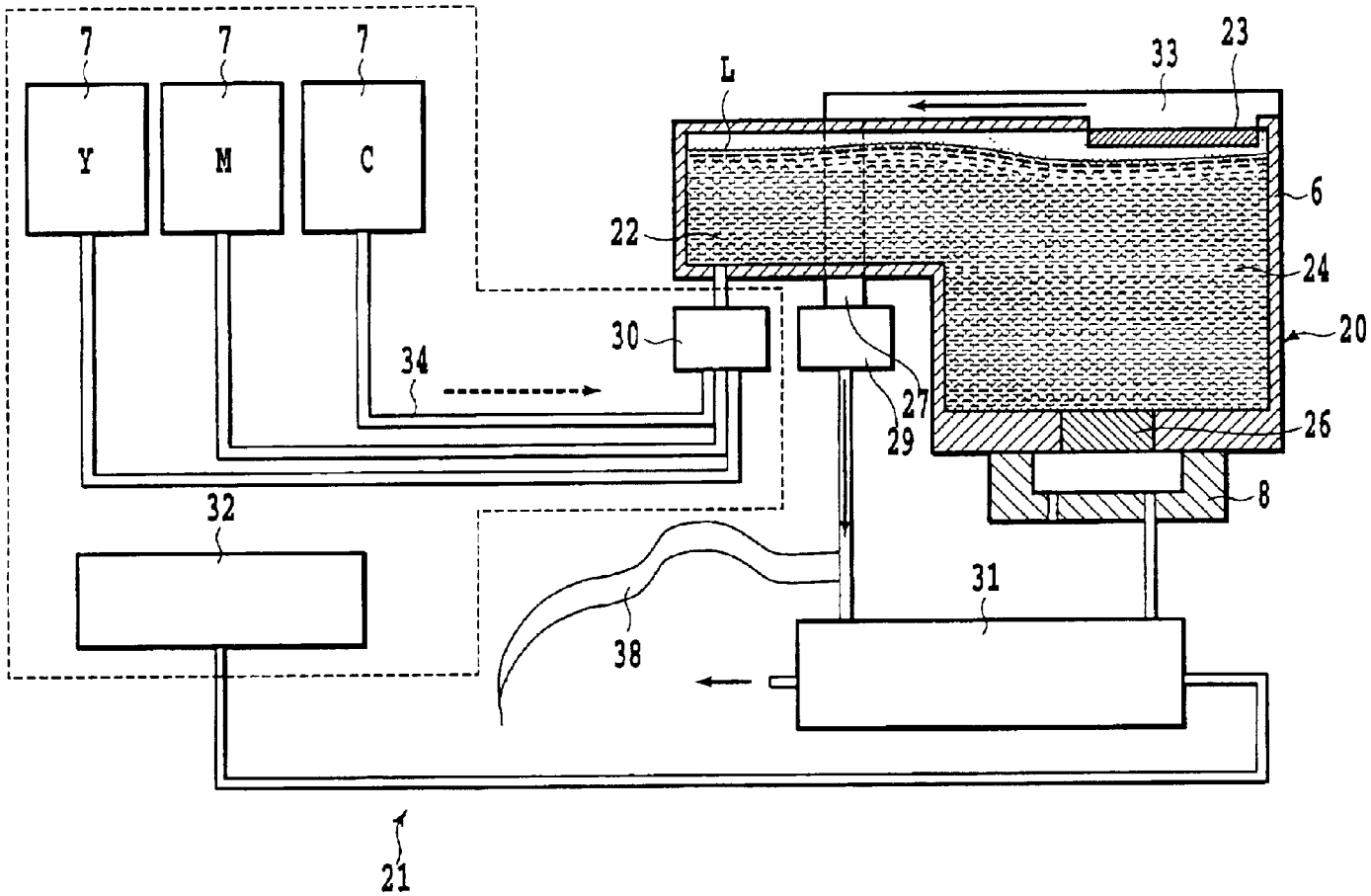
FIG. 24 is a schematic diagram illustrating the configuration of an ink supply system according to a fifth embodiment of the present invention.

FIG. 24 illustrates a fifth embodiment of the present invention. Parts similar to those in FIG. 5, described previously, are denoted by the same reference numerals. Their description is omitted.

A bulging portion forming a buffer 38 may be formed in the middle of the suction path 33 in order to set the volume of the suction path 33 so as to establish the relationship in Equation (1), described above. In this example, a T-shaped portion is provided in the suction path 33 between the suction point 29 and the suction pump 31. The proximal end of a tube with a closed leading end is connected to the T-shaped portion at its position at which the suction path 33 branches. The internal space of the tube constitutes the buffer 38. The tube is deployed in a free space in the printing apparatus. In particular, by forming the tube of a flexible material, the tube can be easily deployed in the free space in the printing apparatus. Therefore, if it is difficult to obtain a space for the buffer 38 owing to the reduced size of the printing apparatus, the space for the buffer 38 can be efficiently and freely provided.

(Other Embodiments)

The liquid supply apparatus of the present invention is widely applicable in order to supply various liquids other than ink to containers.

Further, various methods other than the serial scan method, described above, can be employed for the printing apparatus of the present invention. For example, the printing apparatus of the present invention may be configured on the basis of a so-called full-line method that uses a long print head extending along the entire length of a printing area of a printed medium.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid supply apparatus using a gas-liquid separating membrane that allows a gas to pass through while inhibiting passage of a liquid so that a suction pump can be used to suck air from a container via said gas-liquid separating membrane and a suction path, wherein said suction path is provided with a buffer space that reduces maximum differential pressure exerted on said gas-liquid separating membrane, below a withstanding pressure of said gas-liquid separating membrane, and wherein maximum capacity Wpmax of said suction pump, volume W0 of said suction path including said buffer space, and withstanding pressure Pm of said gas-liquid separating membrane are related as follows:

$$(W0+Wpmax)/W0 \leqq P0-Pm$$

(where Pm<P0, and P0 denotes atmospheric pressure).

2. A liquid supply apparatus as claimed in claim 1, wherein said suction path is connected to a plurality of said containers via a plurality of said gas-liquid separating membranes corresponding to said containers.

3. A liquid supply apparatus as claimed in claim 2, wherein different liquids are supplied to said plurality of containers.

4. A liquid supply apparatus as claimed in claim 1, wherein said suction pump is a positive displacement pump.

5. A liquid supply apparatus as claimed in claim 1, wherein a middle portion of said suction path can be subjected to separation and connection.

6. A liquid supply apparatus as claimed in claim 1, wherein a holding member that can absorb and hold a liquid is provided inside of said container.

7. A liquid supply apparatus as claimed in claim 1, wherein said buffer space is formed of said suction path itself.

8. A liquid supply apparatus as claimed in claim 1, wherein at least part of said buffer space is formed in said suction pump.

9. A liquid supply apparatus as claimed in claim 8, wherein said suction pump is a syringe pump.

10. A liquid supply apparatus as claimed in claim 1, wherein at least part of said buffer space is formed of a bulging portion provided in a middle portion of said suction path.

11. A liquid supply apparatus as claimed in claim 1, wherein said liquid is ink.

12. A printing apparatus that carries out printing on a printing medium by applying ink supplied from an ink supply source, the apparatus comprising:

a liquid supply apparatus as claimed in claim 11, and wherein said ink supply source comprises a container that accommodates the ink supplied by said liquid supply apparatus.

13. A printing apparatus as claimed in claim 12, wherein the ink supplied from said container is applied to said printing medium using an ink-jet print head from which the ink can be ejected.

14. A printing apparatus as claimed in claim 13, wherein said ink-jet print head is integrally or separably joined to said container to constitute an ink-jet print head unit that can be moved relative to said printing medium.

15. A printing apparatus as claimed in claim 14, further comprising means for moving said ink-jet print head unit, and wherein said liquid supply apparatus supplies ink to said container when said ink-jet print head unit moves to a predetermined position.

16. A printing apparatus as claimed in claim 13, wherein said ink-jet print head comprises an electrothermal converter that generates thermal energy used to eject ink.

* * * * *